US012349818B2

(12) United States Patent
Allison

(10) Patent No.: US 12,349,818 B2
(45) Date of Patent: Jul. 8, 2025

(54) VIBRATIONAL CUP DEVICE

(71) Applicant: David Allison, Clifton, TX (US)

(72) Inventor: David Allison, Clifton, TX (US)

( * ) Notice: Subject to any disclaimer, the term of this patent is extended or adjusted under 35 U.S.C. 154(b) by 67 days.

(21) Appl. No.: 18/317,212

(22) Filed: May 15, 2023

(65) Prior Publication Data

US 2024/0172882 A1 May 30, 2024

Related U.S. Application Data

(60) Provisional application No. 63/428,434, filed on Nov. 29, 2022.

(51) Int. Cl.
*A47G 19/22* (2006.01)

(52) U.S. Cl.
CPC .... *A47G 19/2211* (2013.01); *A47G 2200/205* (2013.01)

(58) Field of Classification Search
CPC ..... A45J 43/046; A45J 43/06; A45J 43/085; B65D 25/20; A47G 19/2205; A47G 2200/205; A47J 43/046; A47J 43/06; A47J 43/085
See application file for complete search history.

(56) References Cited

U.S. PATENT DOCUMENTS

| | | | | |
|---|---|---|---|---|
| 3,435,994 | A * | 4/1969 | Freed | A47G 19/24 222/196 |
| 7,417,417 | B2 | 8/2008 | Williams | |
| 10,329,061 | B2 | 6/2019 | Dias | |
| 10,591,138 | B1 * | 3/2020 | Blackdiamond | B01F 27/80 |
| 11,253,090 | B2 | 2/2022 | Liu | |
| 2005/0217369 | A1 | 10/2005 | Holappa | |
| 2006/0198241 | A1 * | 9/2006 | Krishnachaitanya | A47J 43/046 366/205 |
| 2010/0151083 | A1 * | 6/2010 | Klier | B67D 1/0034 426/66 |
| 2020/0339309 | A1 | 10/2020 | Krafft | |
| 2021/0308386 | A1 * | 10/2021 | Mayle, Jr. | A61M 5/31596 |

* cited by examiner

*Primary Examiner* — Andrew T Kirsch
(74) *Attorney, Agent, or Firm* — Brennan, Manna & Diamond, LLC

(57) ABSTRACT

A vibrational cup device is disclosed that prevents a drink from spilling as ice readjusts within. The vibrational cup device comprises a base component positioned on a bottom portion of a cup and sealed with O-rings. The base component is removable and comprises a rechargeable battery, a micro circuit board, a vibrational motor, a USB port with plug, and a motion sensor that tells the device when the cup is at a 45-to-60-degree angle. At these angles, the vibrational motor would engage for approximately 10 seconds to help break up the ice in the cup or to level out the ice to prevent the sudden release of ice cubes, thus spilling part of the drink.

16 Claims, 3 Drawing Sheets

VIBRATIONAL CUP DEVICE

CROSS-REFERENCE TO RELATED APPLICATION

The present application claims priority to, and the benefit of, U.S. Provisional Application No. 63/428,434, which was filed on Nov. 29, 2022, and is incorporated herein by reference in its entirety.

FIELD OF THE INVENTION

The present invention relates generally to the field of vibrational cup devices. More specifically, the present invention relates to an improved cup device designed to reduce a rush of fluid due to ice, when a user takes a drink from the cup device. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in vibrational cup devices. Generally, people may opt to place ice in a beverage while drinking from a cup or glass. As the cup is tilted toward the mouth, the ice typically rushes toward the lips and can cause discomfort. For example, the ice can come rushing toward a user, which causes the drink to spill on the user's face. Further, the ice becomes unlevel and blocks or impedes the user's ability to drink the beverage.

Additionally, without ice, beverages can get warm and unenjoyable quickly. Furthermore, some users want the ice to dilute their beverages. Accordingly, for some users, ice is a necessity for their cold beverages or drinks.

Accordingly, a need remains for a cup that can break up ice and prevent it from rushing forward to a user. Further, a vibrational cup device is necessary to break up ice and prevent blockages and spills.

Therefore, there exists a long-felt need in the art for a vibrational cup device that provides users with an improved cup designed to reduce fluid tidal waves that occur when people take a drink from the cup. There is also a long-felt need in the art for a vibrational cup device that allows users to put ice in their cups without worry of it rushing toward their lips in a single clump while taking a drink. Further, there is a long-felt need in the art for a vibrational cup device that includes a sensor that detects when the cup is tilted at 45 to 60 degrees, activating an integrated vibrational motor to level out the ice. Moreover, there is a long-felt need in the art for a device that features a USB port to recharge the internal motor and its battery with ease. Further, there is a long-felt need in the art for a vibrational cup device that is shaped as a tumbler cup. Finally, there is a long-felt need in the art for a vibrational cup device that would be manufactured of a plastic material.

The subject matter disclosed and claimed herein, in one embodiment thereof, comprises a vibrational cup device. The device is a tumbler cup that prevents a drink from spilling as ice readjusts within. The vibrational cup device comprises a base component positioned on a bottom portion of the cup and sealed with O-rings. The base component is removable and comprises a rechargeable battery, a micro circuit board, a cell phone type vibrational motor, a USB port with plug, and a motion sensor that tells the device when the cup is at a 45-to-60-degree angle. At these angles, the vibrational motor would engage for approximately 10 seconds to help break up the ice in the cup or to level out the ice, to prevent the user from a sudden release of ice cubes, thus spilling part of the drink.

Generally, the base component comprises a threaded adapter for securing the base component to the cup. The USB port allows the device to be charged. The base component would be made of the same plastic material as the cup. When washing is required, users would remove the base component and wash the cup.

In this manner, the vibrational cup device of the present invention accomplishes all of the foregoing objectives and provides users with a device that breaks up ice while drinking. The device includes a sensor that detects when the cup is tilted, activating the vibrational motor. The vibrational motor acts to break up the ice in the cup device.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a vibrational cup device. The device is a tumbler cup that prevents a drink from spilling as ice readjusts within. The vibrational cup device comprises a base component positioned on a bottom portion of the cup and sealed with O-rings. The base component is removable and comprises a rechargeable battery, a micro circuit board, a cell phone type vibrational motor, a USB port with plug, and a motion sensor that tells the device when the cup is at a 45-to-60-degree angle. At these angles, the vibrational motor would engage for approximately 10 seconds to help break up the ice in the cup or to level out the ice, to prevent the user from a sudden release of ice cubes, thus spilling part of the drink.

In one embodiment, the vibrational cup device comprises a base component and a cup portion. Both the base component and the cup portion would be made of the same material, typically a plastic material, but does not have to be and can be made of different materials. Generally, the base component and the cup portion can be made of any suitable materials as is known in the art, depending on the needs and/or wants of a user. Furthermore, the cup portion would be shaped and sized to resemble a typical cup as is known in the art. Additionally, the cup portion can be any suitable shape and size as is known in the art and can further be manufactured in various shapes and sizes, depending on the needs and/or wants of a user. The cup portion is typically cylindrical in shape with an open upper end.

In one embodiment, the base component is secured to a bottom of the cup portion. Typically, the base component is the same diameter as the cup portion, so that once attached, the base component is flush with the cup portion. Further, once attached, it can be virtually indistinguishable as to where the cup portion ends, and the base component begins. Thus, when the base component is secured to the cup portion, a vibrational cup device is formed as a single component or device.

In one embodiment, the base component is threaded onto the cup portion. Specifically, the base component can comprise a threaded adapter, wherein the top of the base component comprises a plurality of threads which engage with the plurality of corresponding threads on the underside of the bottom of the cup portion. Thus, the base component can be easily secured and removed from the cup portion, as needed. For example, when washing is required, users can remove the base component and wash the cup portion without disturbing the electronics within the base component. Further, any other suitable securing means as is known in the art can be utilized instead of the plurality of threads, such as press fit, hook and loop fasteners, adhesive, etc.

In another embodiment, the base component comprises an annular groove around its top edge, in which there is disposed a rubber O-ring adapted to abut the wall of the base component to allow the base component to be tightly secured against the cup portion when threaded. By this water-tight engagement of the base component with the cup portion, the sensors, motors, and electronics can be safely positioned within the base component without worry of them getting wet from liquids within or on the cup portion.

In one embodiment, the base component comprises a rechargeable battery, a micro circuit board, a cell phone type vibrational motor, a USB port with plug, and a motion sensor that tells the device when the cup is at a 45-to-60-degree angle, and any other suitable electronics, sensors, and motors that are needed, as is known in the art.

In one embodiment, the vibrational motor is a cell phone type vibrational motor but can be any suitable vibrational motor as is known in the art. The vibrational motor need only produce low frequency, low amplitude vibrations to vibrate the liquid and ice within the cup portion. Further, the vibrational motor is in communication with the motion sensor. The motion sensor can be any suitable motion sensor as is known in the art. The motion sensor detects when the vibrational cup device is tilted upward toward a user's mouth, as to drink. Specially, the motion sensor detects when the cup device is tilted at a 45-to-60-degree angle toward a user's mouth. When the cup device is tilted within this threshold, the motion sensor is engaged, which communicates with the vibrational motor to activate the motor and vibrate the liquid and ice within the device. Generally, the vibrational motor would engage for approximately five to ten seconds to help break up the ice in the cup or to level out the ice to prevent the user from a sudden release of ice cubes, thus spilling part of the drink. However, the vibrational motor can engage for any suitable amount of time as is known in the art, depending on the needs and/or wants of a user.

In one embodiment, the micro circuit board is in communication with the vibrational motor and the motion sensor, as well as the rechargeable battery. The rechargeable battery may be disposed on or within the base component. The rechargeable battery acts to power the vibrational motor and the motion sensor.

In another embodiment, the battery may be a disposable battery or a rechargeable battery in the form of an alkaline, nickel-cadmium, nickel-metal hydride battery, etc., such as any 3V-12 volts DC battery or other conventional battery, such as A, AA, AAA, etc., that supplies power to the vibrational cup device. Throughout this specification, the term "battery" may be used interchangeably to refer to one or more wet or dry cells or batteries of cells in which chemical energy is converted into electricity and used as a source of DC power. References to recharging or replacing the battery may refer to recharging or replacing individual cells, individual batteries of cells, or a package of multiple battery cells as is appropriate for any given battery technology that may be used.

In one embodiment, a rechargeable embodiment of the battery may be recharged using a USB port, wherein the USB port is a USB-A, USB-B, Micro-B, Micro-USB, Mini-USB, USB-C port, etc. The USB port is typically positioned on the outside or exterior side of the base component. The USB port comprises a rubber plug to shield the port and keep it clean. The vibrational cup device also comprises a charging cord to allow the base component to be charged via the USB port, when not in use.

In one embodiment, the base component comprises a power switch for manually operating the vibrational motor. Generally, the power switch is located on the outside side of the base component.

In one embodiment, the base component is provided so that the liquid and ice contained in the cup portion does not penetrate into the base component. To this end, the electronics, motor, sensor, and battery are provided in the base component and separately provided from the cup portion.

In operation, the base component is threaded onto the cup portion and liquid and ice are poured into the cup portion. The user then drinks from the cup portion, as you would from a standard cup. Then, when the cup portion is tilted between a 45-to-60-degree angle, the motion sensor engages the vibrational motor to vibrate the cup portion. The vibrating cup portion breaks up and levels out the ice, allowing a user to drink from the cup portion without worry of accidents or spills.

In one embodiment, the vibrational cup device is manufactured from lightweight metals or heat-resistant plastics or polymers, such as polypropylene, polycarbonate, or acrylonitrile-butadiene-styrene (ABS), or any other suitable material as is known in the art, such as, but not limited to, acrylic, polycarbonate, polyethylene, thermoplastic, low density polyethylene, medium density polyethylene, high density polyethylene, polyethylene terephthalate, polyvinyl chloride, polystyrene, polylactic acid, acetal, etc. Generally, the vibrational cup device is also manufactured from a material that is water resistant or water permeable, or the base component comprises a coating that is water resistant or water permeable.

In yet another embodiment, the vibrational cup device comprises a plurality of indicia.

In yet another embodiment, a method of vibrating ice within a cup to break up the ice and reduce spills and accidents is disclosed. The method comprises providing a vibrational cup device comprising a base component with a rechargeable battery, a micro circuit board, a vibrational motor, a USB port, and a motion sensor that is secured to a cup portion. The method also comprises securing the base component to the cup portion via a threaded adapter. Further, the method comprises tilting the cup device, such that the motion sensor is engaged which activates the vibrational motor. The method also comprises vibrating the ice within the cup portion via the vibrational motor. Finally, the method comprises drinking from the cup device without worry of spills or accidents due to ice blockage.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
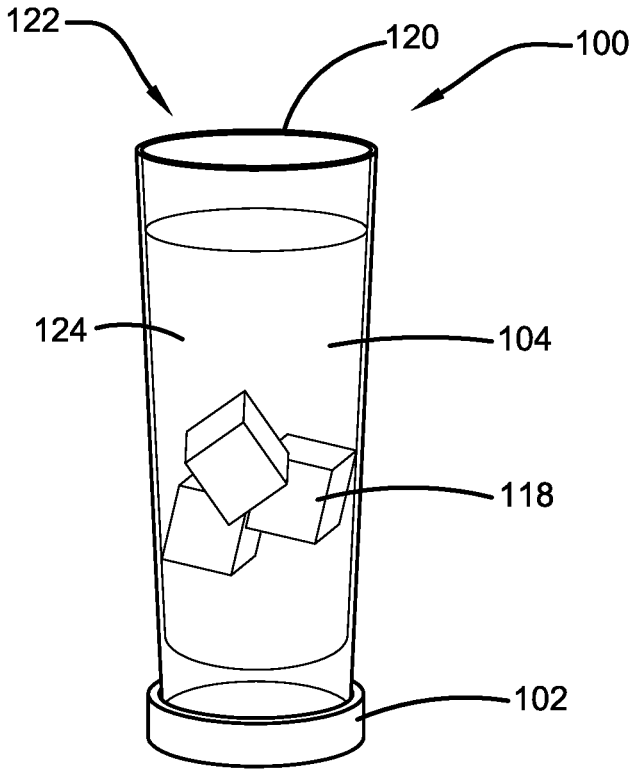
FIG. 1 illustrates a front perspective view of one embodiment of the vibrational cup device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a vibrational cup device that provides users with an improved cup designed to reduce fluid tidal waves that occur when people take a drink from the cup. There is also a long-felt need in the art for a vibrational cup device that allows users to put ice in their cups without worry of it rushing toward their lips in a single clump while taking a drink. Further, there is a long-felt need in the art for a vibrational cup device that includes a sensor that detects when the cup is tilted at 45 to 60 degrees, activating an integrated vibrational motor to level out the ice. Moreover, there is a long-felt need in the art for a device that features a USB port to recharge the internal motor and its battery with ease. Further, there is a long-felt need in the art for a vibrational cup device that is shaped as a tumbler cup. Finally, there is a long-felt need in the art for a vibrational cup device that would be manufactured of a plastic material.

The present invention, in one exemplary embodiment, is a novel vibrational cup device. The device comprises a base component positioned on a bottom portion of the cup and sealed with O-rings. The base component is removable and comprises a rechargeable battery, a micro circuit board, a vibrational motor, a USB port with plug, and a motion sensor that tells the device when the cup is at a 45-to-60-degree angle. At these angles, the vibrational motor would engage for approximately 10 seconds to help break up the ice in the cup or to level out the ice, to prevent the sudden release of ice cubes, thus spilling part of the drink. The present invention also includes a novel method of vibrating ice within a cup to break up the ice and reduce spills and accidents. The method comprises providing a vibrational cup device comprising a base component with a rechargeable battery, a micro circuit board, a vibrational motor, a USB port, and a motion sensor that is secured to a cup portion. The method also comprises securing the base component to the cup portion via a threaded adapter. Further, the method comprises tilting the cup device, such that the motion sensor is engaged which activates the vibrational motor. The method also comprises vibrating the ice within the cup portion via the vibrational motor. Finally, the method comprises drinking from the cup device without worry of spills or accidents due to ice blockage.

Referring initially to the drawings, FIG. 1 illustrates a perspective view of one embodiment of the vibrational cup device 100 of the present invention. In the present embodiment, the vibrational cup device 100 is an improved tumbler cup that prevents a drink from spilling as ice readjusts within. Specifically, the vibrational cup device 100 comprises a base component 102 secured to a bottom 116 of the cup portion 104. The base component 102 is removable and comprises a rechargeable battery 106, a micro circuit board 108, a vibrational motor 110, a USB port 112, and a motion sensor 114 that tells the device 100 when the cup portion 104 is being tilted upward at an angle. Once tilted, the vibrational motor 110 would engage to help break up the ice 118 in the cup portion 104 or to level out the ice 118 to prevent the sudden release of ice cubes 118, thus spilling part of the drink.

Generally, the vibrational cup device 100 comprises a base component 102 and a cup portion 104. Both the base component 102 and the cup portion 104 would be made of the same material, typically a plastic material, but don't have to be and can be made of different materials, if desired. Generally, the base component 102 and the cup portion 104 can be made of any suitable materials as is known in the art, depending on the needs and/or wants of a user. Furthermore, the cup portion 104 would be shaped and sized to resemble a typical cup as is known in the art. Accordingly, the cup portion 104 is typically cylindrical in shape with an open upper end 120 and a recessed cavity 122 that can be filled with liquids 124 and/or ice 118. Additionally, the cup portion 104 can be any suitable shape and size as is known in the art and can further be manufactured in various shapes and sizes, depending on the needs and/or wants of a user.

In one embodiment, the vibrational cup device 100 can be configured as a kit which includes multiple cup portions 104 and a single base component 102. The single base component 102 can be mixed and matched, and removably secured to any of the cup portions 104, as needed. The multiple cup portions 104 can be of varying heights and sizes.

Generally, the base component 102 is secured to a bottom 116 of the cup portion 104. Typically, the base component 102 is the same diameter as the cup portion 104, so that once attached, the base component 102 is concentric with the cup portion 104. Further, once attached, it can be virtually indistinguishable as to where the cup portion 104 ends and the base component 102 begins. Thus, when the base component 102 is secured to the cup portion 104, a vibrational cup device 100 is formed as a single component or device.

Figure 2:
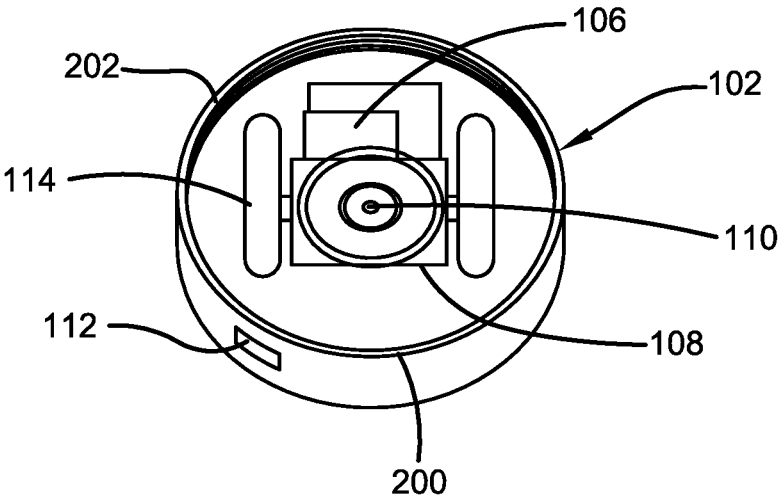
FIG. 2 illustrates a top perspective view of one embodiment of the vibrational cup device of the present invention showing the base component with vibrational motor in accordance with the disclosed architecture.

As shown in FIG. 2, the base component 102 is threaded onto the cup portion 104. Specifically, the base component 102 can comprise a threaded adapter, or threads 200 that engage with the cup portion. Thus, the top 202 of the base component 102 comprises a plurality of threads 200 which engage with the plurality of corresponding threads 204 on the underside of the bottom 206 of the cup portion 104. Accordingly, the base component 102 can be easily secured and removed from the cup portion 104, as needed. For example, when washing is required, users can remove the base component 102 and wash the cup portion 104 without disturbing the electronics within the base component 102. Further, any other suitable securing means as is known in the art can be utilized instead of the plurality of threads 200, such as press fit, hook and loop fasteners, adhesive, etc.

Furthermore, the base component 102 comprises an annular groove 208 around its top edge 202, in which there is disposed a rubber O-ring 210 or other suitable sealing means as is known in the art adapted to abut the wall 212 of the base component 102 to allow the base component 102 to be tightly secured against the cup portion 104 when threaded. By this water-tight engagement of the base component 102 with the cup portion 104, the sensors, motors, and electronics can be safely positioned within the base component 102 without worry of them getting wet from liquids 124 within or on the cup portion 104. For example, if the cup portion 104 begins to sweat from the drink 124 within its cavity 122, the base component 102 and its electronics would still be protected from the liquid 124.

Generally, the base component 102 comprises a rechargeable battery 106, a micro circuit board 108, a vibrational motor 110, a USB port 112 with plug 214, and a motion sensor 114 that tells the device 100 when the cup portion 104 is at a 45-to-60-degree angle, and any other suitable electronics, sensors, and motors that are needed, as is known in the art. These electronics, sensors, motors, and batteries are all in communication with each other to sense and vibrate the vibrational cup device 100 during use. Furthermore, any other suitable electronics, sensors, motors, or batteries can be utilized as is known in the art and exchanged for what is disclosed and described herein, while still keeping with the spirit and scope of the invention.

In one embodiment, the vibrational motor 110 is a cell phone type vibrational motor but can be any suitable vibrational motor as is known in the art. The vibrational motor 110 need only produce low frequency, low amplitude vibrations to vibrate the liquid 124 and ice 118 within the cup portion 104. Further, in use, the vibrational motor 110 is in communication with the motion sensor 114. The motion sensor 114 can be any suitable motion sensor as is known in the art. The motion sensor 114 detects when the vibrational cup device 100 is tilted upward toward a user's mouth, as to drink. Specifically, the motion sensor 114 is pre-programmed to detect when the cup device 100 is tilted at a specific angle toward a user's mouth. In one embodiment, the motion sensor 114 detects when the cup device 100 is tilted at a 45-to-60-degree angle toward a user's mouth. When the cup device 100 is tilted within this threshold, the motion sensor 114 is engaged which communicates with the vibrational motor 110 to activate the motor 110 and vibrate the liquid 124 and ice 118 within the device 100. Generally, the vibrational motor 110 would engage for approximately five to ten seconds to help break up the ice 118 in the cup portion 104 or to level out the ice 118, to prevent the sudden release of ice cubes 118, thus spilling part of the drink 124. However, the vibrational motor 110 can engage for any suitable amount of time as is known in the art, depending on the needs and/or wants of a user.

Figure 3:
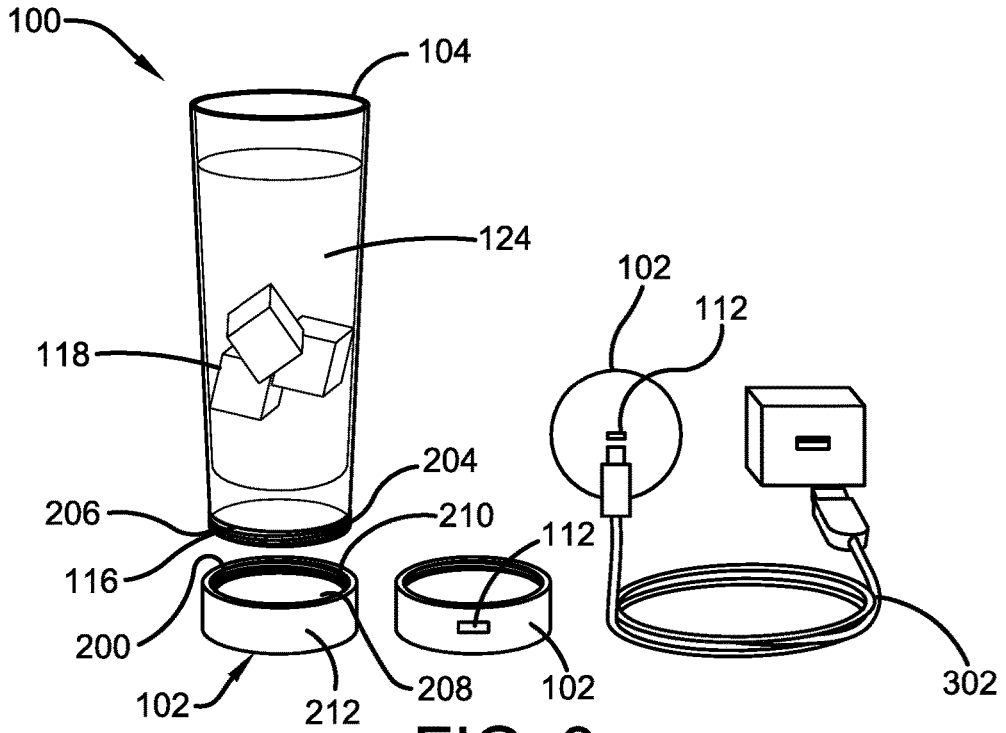
FIG. 3 illustrates a front perspective view of one embodiment of the vibrational cup device of the present invention showing the base component being removed and charged in accordance with the disclosed architecture.

As shown in FIG. 3, the micro circuit board 108 is in communication with the vibrational motor 110 and the motion sensor 114, as well as the rechargeable battery 106. The rechargeable battery 106 may be disposed on or within the base component 102. The rechargeable battery 106 acts to power the vibrational motor 110 and the motion sensor 114, and any other electronics, sensors, or motors within the base component 102.

Generally, the battery 106 may be a disposable battery or a rechargeable battery in the form of an alkaline, nickel-cadmium, nickel-metal hydride battery, etc., such as any 3V-12 volts DC battery or other conventional battery, such as A, AA, AAA, etc., that supplies power to the vibrational cup device 100. Throughout this specification, the term "battery" may be used interchangeably to refer to one or more wet or dry cells or batteries of cells in which chemical energy is converted into electricity and used as a source of DC power. References to recharging or replacing the battery 106 may refer to recharging or replacing individual cells, individual batteries of cells, or a package of multiple battery cells as is appropriate for any given battery technology that may be used.

Further, a rechargeable embodiment of the battery 106 may be recharged using a USB port 112, wherein the USB port 112 is a USB-A, USB-B, Micro-B, Micro-USB, Mini-USB, USB-C port, etc. The USB port 112 is typically positioned on the outside side 300 of the base component 102. The USB port 112 comprises a rubber plug 214 or other suitable device, to shield the port 112 and keep it clean. The vibrational cup device 100 also comprises a charge cord 302 to allow the base component 102 to be charged via the USB port 112, when not in use.

Additionally, the base component 102 comprises a power switch 304 for manually operating the vibrational motor 110. Generally, the power switch 304 is located on the outside or exterior side 300 of the base component 102. The power switch 304 can be turned on to engage the vibrational motor 110 when a user wishes to vibrate the cup device 100 to break up or level out ice 118, without having to tilt up the cup portion 104 to engage the motion sensor 114.

Figure 4:
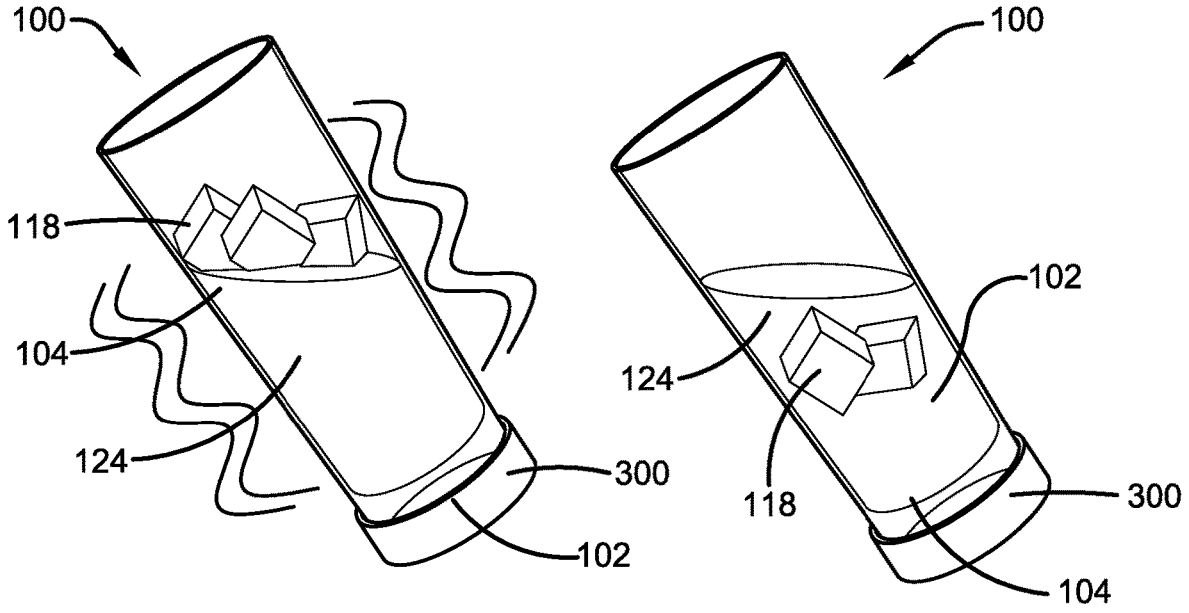
FIG. 4 illustrates a side perspective view of one embodiment of the vibrational cup device of the present invention showing the device vibrating in accordance with the disclosed architecture.

As shown in FIG. 4, the base component 102 is provided so that the liquid 124 and ice 118 contained in the cup portion 104 does not penetrate into the base component 102. To this end, the electronics, motor, sensor, and battery are provided in the base component 102 and provided separately from the cup portion 104, allowing a user to remove the base component 102 as needed and reattach the base component 102 to any desired cup portion 104 as is known in the art.

In operation, the base component 102 is threaded onto the cup portion 104 and liquid 124 and ice 118 are poured into the cup portion 104. The user then drinks from the cup portion 104, as you would from a standard cup. Then, when the cup portion 104 is tilted between a 45-to-60-degree angle, the motion sensor 114 engages the vibrational motor 110 to vibrate the cup portion 104. The vibrational cup device 100 breaks up and levels out the ice 118, allowing a user to drink from the cup portion 104 without worry of accidents or spills.

Figure 5:
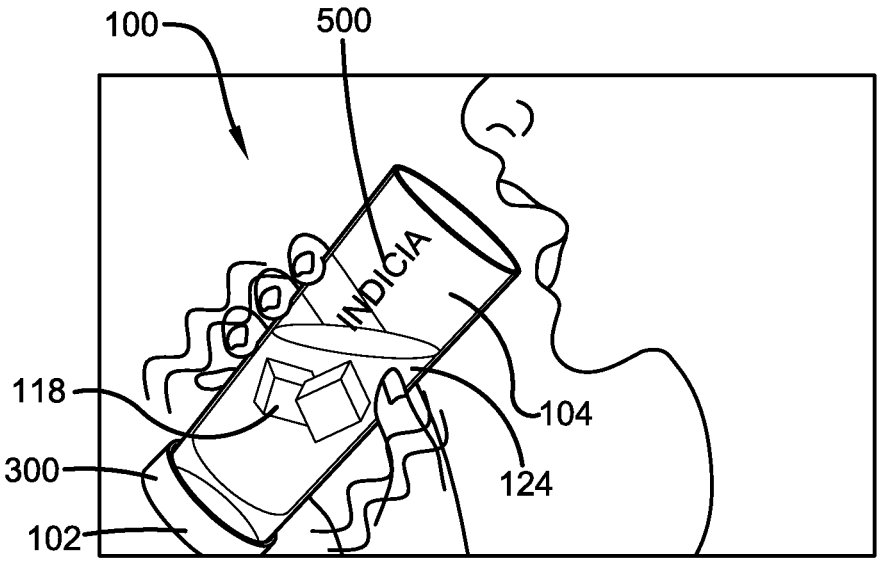
FIG. 5 illustrates a side perspective view of one embodiment of the vibrational cup device of the present invention showing the device in use in accordance with the disclosed architecture.

As shown in FIG. 5, the vibrational cup device 100 is manufactured from lightweight metals or heat-resistant plastics or polymers, such as polypropylene, polycarbonate, or acrylonitrile-butadiene-styrene (ABS), or any other suitable material as is known in the art, such as, but not limited to, acrylic, polycarbonate, polyethylene, thermoplastic, low density polyethylene, medium density polyethylene, high density polyethylene, polyethylene terephthalate, polyvinyl chloride, polystyrene, polylactic acid, acetal, etc. Generally, the vibrational cup device 100 is also manufactured from a material that is water resistant or water permeable, or the base component 102 comprises a coating that is water resistant or water permeable.

In one embodiment, the vibrational cup device 100 comprises a plurality of indicia 500. The body component 102 of the device 100 may include advertising, trademark, other letters, designs, or characters, printed, painted, stamped, or integrated into the body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be drink, ice, or brand related.

Figure 6:
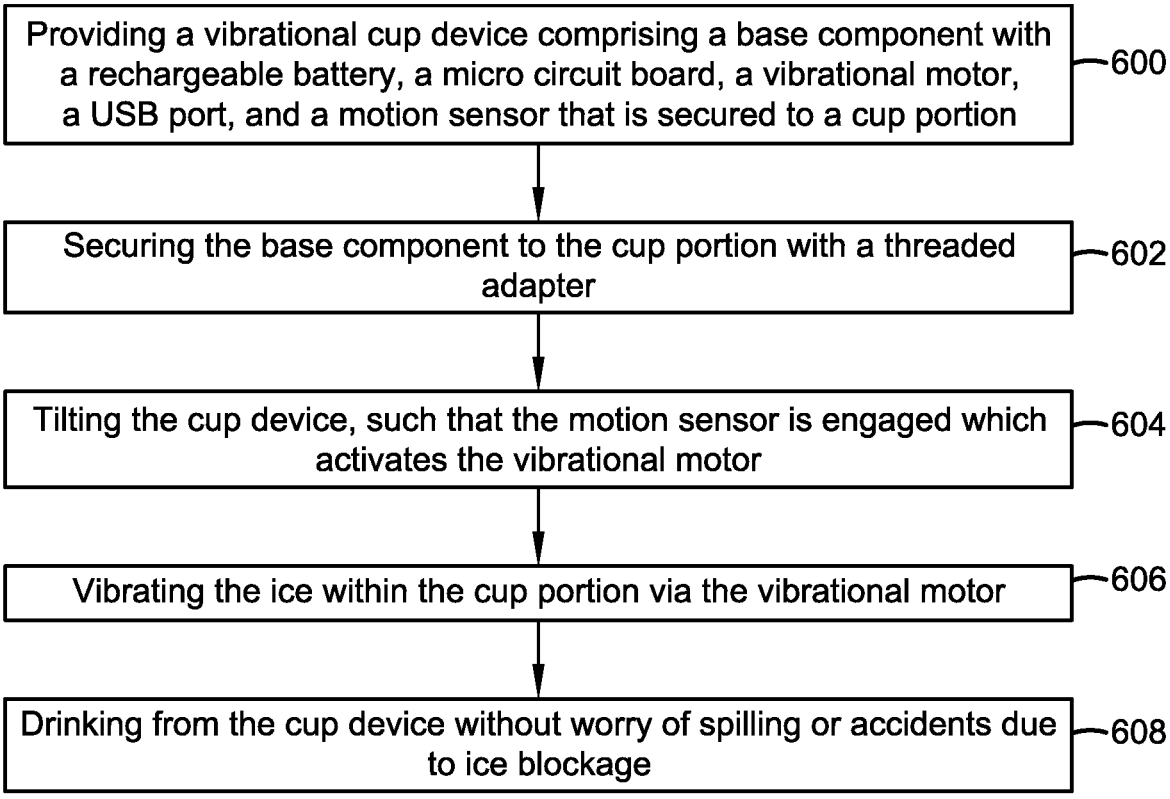
FIG. 6 illustrates a flowchart showing the method of vibrating ice within a cup to break up the ice and reduce spills and accidents in accordance with the disclosed architecture.

FIG. 6 illustrates a flowchart of the method of vibrating ice within a cup to break up the ice and reduce spills and accidents. The method comprises at 600, providing a vibrational cup device comprising a base component with a rechargeable battery, a micro circuit board, a vibrational motor, a USB port, and a motion sensor that are secured to a cup portion. The method also comprises at 602, securing the base component to the cup portion via a threaded adapter. Further, the method comprises at 604, tilting the cup device, such that the motion sensor is engaged which activates the vibrational motor. The method also comprises at 606, vibrating the ice within the cup portion via the vibrational motor. Finally, the method comprises at 608, drinking from the cup device without worry of spills or accidents due to ice blockage.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "vibrational cup device", "cup device", and "device" are interchangeable and refer to the vibrational cup device 100 of the present invention.

Notwithstanding the foregoing, the vibrational cup device 100 of the present invention can be of any suitable size and configuration as is known in the art without affecting the overall concept of the invention, provided that it accomplishes the above-stated objectives. One of ordinary skill in the art will appreciate that the vibrational cup device 100 as shown in FIGS. 1-6 are for illustrative purposes only, and that many other sizes and shapes of the vibrational cup device 100 are well within the scope of the present disclosure. Although the dimensions of the vibrational cup device 100 are important design parameters for user convenience, the vibrational cup device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A vibrational cup device that prevents a drink from spilling as ice readjusts within, the vibrational cup device comprising:

a base component; and a cup portion comprising a liquid and ice;

wherein the base component is secured to a bottom of the cup portion;

wherein the base component comprises a battery, a micro circuit board, a vibrational motor, and a motion sensor in communication;

wherein the motion sensor activates when the cup portion is tilted and engages the vibrational motor which vibrates the cup portion to break up the ice within;

wherein the vibrational cup device can be configured as a kit which includes multiple cup portions of varying heights and sizes and a single base component that can be mixed and matched;

wherein a top of the base component is configured to press fit onto an underside of a bottom of the cup portion; and wherein the motion sensor is configured to activate the vibrational motor to vibrate the vibrational cup device for between 5 and 10 seconds when the motion sensor detects that the vibrational cup device is tilted at an angle of between 45 and 60 degrees.

2. The vibrational cup device of claim 1, wherein the cup portion is cylindrical in shape with an open upper end and a recessed cavity that can be filled with liquids and ice.

3. The vibrational cup device of claim 2, wherein the base component is concentric with the cup portion when attached together.

4. The vibrational cup device of claim 3, wherein a top of the base component comprises a plurality of threads which engage with a plurality of corresponding threads on an underside of a bottom of the cup portion, to allow the base component to be threaded onto the cup portion.

5. The vibrational cup device of claim 4, wherein the base component comprises an annular groove around its top edge, in which there is disposed a rubber O-ring to allow the base component to be tightly secured against the cup portion when threaded.

6. The vibrational cup device of claim 5, wherein the battery is disposed on or within the base component and is rechargeable.

7. The vibrational cup device of claim 6, wherein the base component comprises an USB port for recharging the battery.

8. The vibrational cup device of claim 7, wherein the base component comprises a power switch for manually operating the vibrational motor.

9. The vibrational cup device of claim 8, wherein the base component and the cup portion are manufactured of the same material.

10. A vibrational cup device that prevents a drink from spilling as ice readjusts within, the vibrational cup device comprising:

a base component; and a cup portion which is cylindrical in shape with an open upper end and a recessed cavity that can be filled with liquids and ice;

wherein the base component comprises a battery, a micro circuit board, a vibrational motor, and a motion sensor in communication;

wherein a top of the base component comprises a plurality of screw threads which engage with a plurality of corresponding screw threads on an underside of a bottom of the cup portion, to allow the base component to be threaded onto the cup portion;

wherein the base component comprises an annular groove around its top edge, in which there is disposed a rubber O-ring to allow the base component to be tightly secured against the cup portion when threaded;

wherein the battery is disposed on or within the base component and is rechargeable;

wherein the base component comprises an USB port for recharging the battery, a rubber USB port plug shield, and a charging cord;

wherein the vibrational cup device can be configured as a kit which includes multiple cup portions of varying heights and sizes and a single base component that can be mixed and matched; and wherein the motion sensor is configured to activate the vibrational motor to vibrate the vibrational cup device for between 5 and 10 seconds when the motion sensor detects that the vibrational cup device is tilted at an angle of between 45 and 60 degrees.

11. The vibrational cup device of claim 10 further comprising a plurality of indicia.

12. The vibrational cup device of claim 10, wherein the base component comprises a power switch for manually operating the vibrational motor.

13. The vibrational cup device of claim 10, wherein the base component and the cup portion are manufactured of the same material.

14. The vibrational cup device of claim 10, wherein the base component and the cup portion are manufactured of different materials.

15. The vibrational cup device of claim 10, wherein the base component is concentric with the cup portion when attached together.

16. A method of vibrating ice within a cup to break up the ice and reduce spills and accidents, the method comprising the following steps:

providing a vibrational cup device comprising a base component with a rechargeable battery, a micro circuit board, a vibrational motor, a USB port and a motion sensor that is secured to a cup portion, wherein the vibrational cup device can be configured as a kit which includes multiple cup portions of varying heights and sizes and a single base component that can be mixed and matched;

securing the base component to the cup portion via a screw thread adapter;

tilting the cup device, such that the motion sensor is engaged which activates the vibrational motor;

vibrating the ice within the cup portion via the vibrational motor; and drinking from the cup device without worry of spilling or accidents due to ice blockage; and wherein the motion sensor is configured to activate the vibrational motor to vibrate the vibrational cup device for between 5 and 10 seconds when the motion sensor detects that the vibrational cup device is tilted at an angle of between 45 and 60 degrees.

* * * * *